United States Patent [19]

Dorri et al.

[11] Patent Number: 4,926,647

[45] Date of Patent: May 22, 1990

[54] CRYOGENIC PRECOOLER AND CRYOCOOLER COLD HEAD INTERFACE RECEPTACLE

[75] Inventors: Bizhan Dorri, Clifton Park; Evangelos T. Laskaris, Schenectady, both of N.Y.

[73] Assignee: General Electric Company, Schenectady, N.Y.

[21] Appl. No.: 335,466

[22] Filed: Apr. 10, 1989

[51] Int. Cl.[5] ..... F25B 19/00

[52] U.S. Cl. ..... 62/51.1; 174/15.4; 250/352; 505/892

[58] Field of Search ..... 62/51.1; 250/352; 505/892; 174/15.4

[56] References Cited

U.S. PATENT DOCUMENTS

| | | | |
|---|---|---|---|
| 4,692,560 | 9/1987 | Hotta et al. | 62/51.1 |
| 4,721,934 | 1/1988 | Stacy | 335/300 |
| 4,841,268 | 6/1989 | Burnett et al. | 62/51.1 |

*Primary Examiner*—Ronald C. Capossela

*Attorney, Agent, or Firm*—William H. Steinberg; James C. Davis, Jr.; Paul R. Webb, II

[57] ABSTRACT

A superconductive magnet coolable with a two stage cryocooler is provided. The superconductive magnet includes a cryostat containing a magnet winding, a thermal radiation shield surrounding the magnet winding and spaced away therefrom. The cryostat defines an aperture in which a cryocooler cold head interface receptacle is situated. The interface receptacle has a first and second heat station for connecting in a heat flow relationship with the first and second heat stations of the crycooler, respectively. A precooler has first and second stage heat exchangers connected in a heat flow relationship with the first and second heat stations of said interface, respectively. The interface has an inlet and outlet port for supplying and removing cryogens. Piping means fabricated from heat insulating material connect the first and second heat exchangers in a series flow relationship between the inlet and outlet ports.

2 Claims, 1 Drawing Sheet

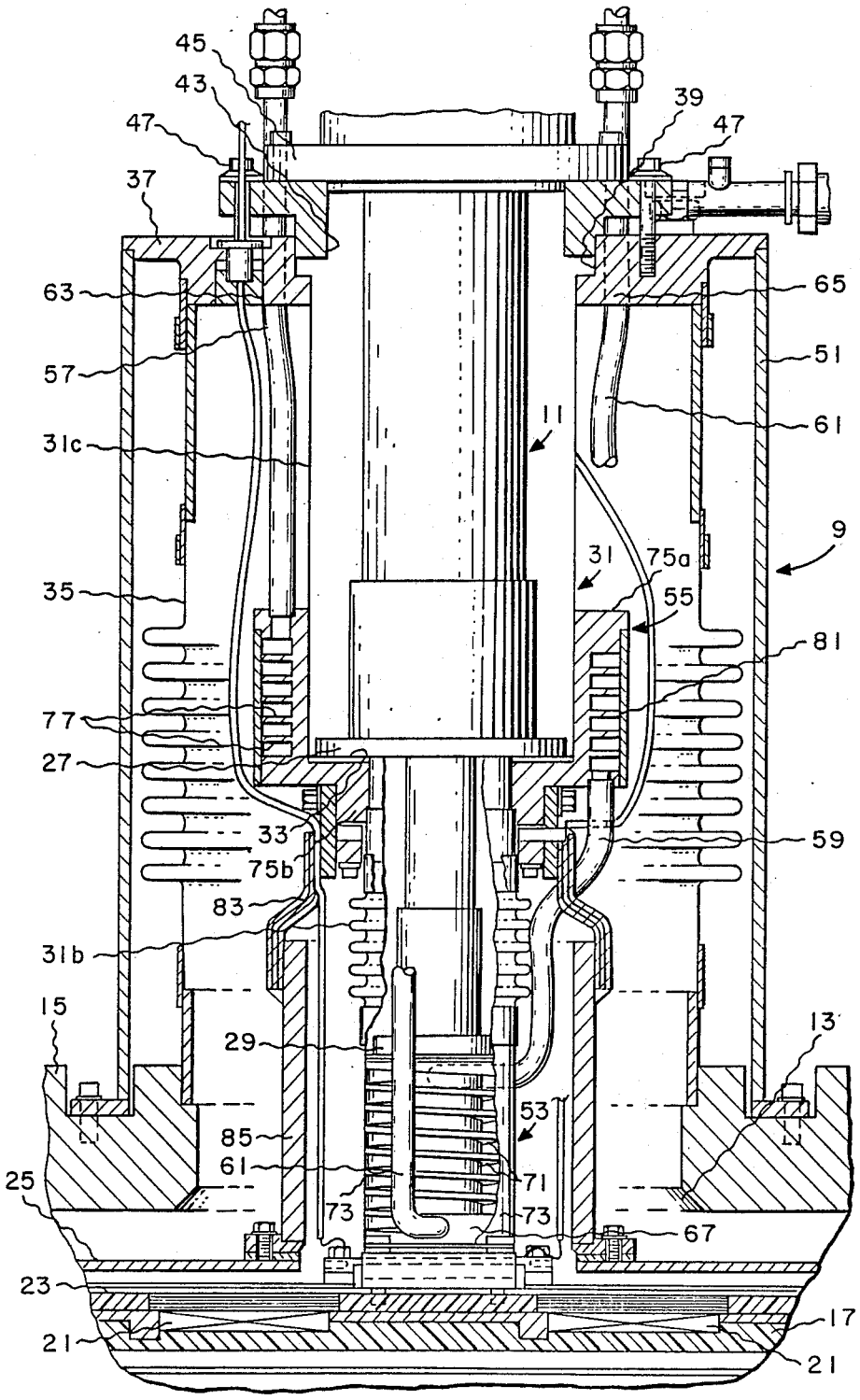
45
43
47
37
39
47
63
65
57
51
31c
11
61
9
31
75a
35
55
81
77
27
33
59
75b
83
31b
15
13
29
53
85
61
71
25
73
73
67
23
17
21
21

CRYOGENIC PRECOOLER AND CRYOCOOLER COLD HEAD INTERFACE RECEPTACLE

CROSS REFERENCE TO RELATED APPLICATIONS

The present invention is related to copending applications, "Cryocooler Cold Head Interface Receptacle", Ser. No. 215,114, now abandoned, and "Cryogenic Precooler for Superconductive Magnets", Ser. No. 07/335,268 both assigned to the same assignee as the present invention.

BACKGROUND OF THE INVENTION

The present invention relates to a cryogenic precooler used during the initial cool down operation of a superconductive magnet. The precooler is a part of the superconductive magnet.

Superconducting magnets now in use operate at very low temperatures. To start up these magnets, the sensible heat needs to be extracted from the magnet to cool them from room temperature to cryogenic temperatures. Due to the large mass of the magnets used for whole body magnetic resonance imaging, the amount of energy to be withdrawn is substantial. A slow cooling of the magnet using the cryocooler, which is typically sized for steady state operation, can take many days. A fast cooling of the magnet can, however, result in thermal stresses which could structurally damage the magnet.

It is an object of the present invention to provide a precooler which can quickly cool down a superconductive magnet at a controlled rate to avoid excessive thermal stresses.

Presently precooling is accomplished in magnets having a cryocooler by cooling the shield by passing cryogenic liquid through a tube which is loosely wound around the magnet shield.

SUMMARY OF THE INVENTION

In one aspect of the present invention a superconductive magnet coolable with a two stage cryocooler is provided. The superconductive magnet includes a cryostat containing a magnet winding, a thermal radiation shield surrounding the magnet winding and spaced away therefrom. The cryostat defines an aperture in which a cryocooler cold head interface receptacle is situated. The interface receptacle has a first and second heat station for connecting in a heat flow relationship with the first and second heat stations of the crycooler, respectively. A precooler has first and second stage heat exchangers connected in a heat flow relationship with the first and second heat stations of said interface, respectively. The interface has an inlet and outlet port for supplying and removing cryogens. Piping means fabricated from heat insulating material connect the first and second heat exchangers in a series flow relationship between the inlet and outlet ports.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing FIGURE in which a partial sectional view of a precooler, cryostat, and cold head interface receptacle of a superconductive magnet is shown in accordance with the present invention.

DETAILED DESCRIPTION OF THE INVENTION

Referring now to the sole FIGURE, a cryocooler cold head interface receptacle described in copending application Ser. No. 215,114, now abandoned, entitled "Cryocooler Cold Head Interface Receptacle", filed July 5, 1988, and hereby incorporated by reference, is shown as part of superconductive magnets which has been modified to include a precooler.

The cryocooler interface 9 is provided to removably connect a two stage cryocooler 11 to an opening 13 in a cryostat 15. The cryostat contains a cylindrical winding form 17 around which superconductive windings 21 are wound. The winding form is enclosed in copper casing 23 and supported inside the cryostat 15 by a suspension system (not shown). Surrounding the coil form containing the magnet windings but spaced away from the coil form and cryostat is a thermal radiation shield 25.

The cryocooler 11 is used to cool the windings 21 and the shield 25. The cryocooler 11 has two stages which achieve two different temperatures which are available at the cryostat first and second stage heat stations 27 and 29, respectively. The temperature achieved at the second heat station 29 is colder than the temperature achieved at the first heat station 27.

The cryocooler interface includes a first sleeve 31 having a closed end **31*a* which serves as the second stage heat station for the interface. A first stage heat station 33 for the interface is located inside the sleeve 31. The portion of the sleeve extending between the first stage heat station and the second stage heat station 31*b*** is axially flexible and thermally insulated due to stainless steel bellows.

A second sleeve 35 surrounds the first sleeve 31. One open end of the second sleeve airtightly surrounds the perimeter of the cryostat opening 13. The sleeve walls are axially flexible and thermally insulative. The sleeve can be fabricated from stainless steel and include a flexible bellows portion.

A first flange 37 having a central aperture 39 is airtightly secured to the first and second sleeves 31 and 35, respectively, sealing the annulus formed between the first and second sleeves. The portion of the first sleeve extending from the first stage heat station and the fist flange **31*c* is fabricated from thermally insulating material such as thin wall stainless steel tubing. The central aperture of the first flange 39 is aligned with the first sleeves open end. The first sleeve, second sleeve and flange 37 airtightly seal the cryostat opening 39. A second flange 41 has a central opening 43 and is adjustably airtightly secured in the central aperture 39 of the first flange 37. The second flange is secured to a flange 45 of the cryocooler 11. With the cryocooler cold end situated in the first sleeve and the cryostat and first sleeve evacuated and the first sleeve exerts pressure between the second stage 29 of the cryocooler and the bottom of the inner sleeve 31. Moving the first flange 37 toward the second flange 43 by tightening bolts 47 elongates the axial flexible portion of the inner sleeve, increasing the force between the first stage interface heat station 33 and the cryostat heat station 27. The split collar 51 limits the movement of the flanges 37 and 47** toward the cryostat 15 when the cryostat is evacuated and the cryocooler 11 removed from its receptacle.

The closed end of the first sleeve 31 is supported against the copper surface 23 of the winding form 17 through a second stage heat exchanger 53. The second stage heat exchanger is part of a precooler. In addition to the second stage heat exchanger, the precooler comprises a first stage heat exchanger 55, piping 57, 59, and 61, and, inlet and outlet ports 63 and 65 situated in the first flange 37. The second stage heat exchanger 53 comprises a cylindrical core 67 of material with high thermal conductivity such as copper. A helical groove 71 is machined in the outer surface of the core. A sleeve of copper 73 is shrunk fit around the core 67 creating helical passageways beginning at one axial end of the core and ending at the other.

The first stage heat station 33 of the interface is formed as a part of the first stage heat exchanger 55. The first stage heat exchanger 55 comprises a cylindrical shell 75*a* of material having good thermal conductivity which has a large diameter portion, 75*a* a small diameter portion 75*b* and a radially inwardly extending ledge transitioning between the two 33. The shell forms a portion of the inner sleeve 33 with the shell axially aligned with the sleeve wall. The smaller diameter portion 75*b* is positioned toward the closed end of the sleeve. The ledge portion serves as the first stage heat station 33 of the interface. The larger diameter shell portion 75*a* has a helical groove 77 machined in the outer surface. A copper sleeve 81 is shrunk fit around the larger diameter shell portion 75*a* enclosing the grooves 77 forming a helical passageway. The small diameter 75*b* portion is attached through a plurality of braided copper straps 83 to a collar 85 of low emissivity material such as copper which is secured to the shield 25 in a manner to achieve good heat flow from the shield to the first heat station 33 of interface.

The two stage cryocooler 11 is shown in the first sleeve 31 of the interface with the first stage heat station of the cryostat 33 in contact with the first stage heat station 27 of the interface through a pliable heat conductive material such as an indium gasket (not shown). The second stage of the cryocooler 29 is in contact with the core 67 through a pliable heat conductive gasket (not shown).

Flange 37 has an inlet port 63 and an outlet port 65 for allowing piping made of material having low thermal conductivity such as stainless steel to extend inside the interface and circulate cryogenic liquid in the heat exchangers 53 and 55. Piping 57 extends from the inlet portion to an aperture in shell 75*a* in flow communication with one end of the helical passageway. Piping 59 extends form an aperture in shell 75*a* in flow communication with the other end of the helical passageway to an aperture in the second stage heat exchanger 53 in flow communication with one end of the helical passageway. Piping 61 extending from an aperture in flow communication with the other end of the helical passageway connects to the outlet port 65.

Joining of copper parts to copper parts can be done by electron beam or welding or brazing. Joining of stainless steel parts to copper parts can be done by brazing.

In operation during precooling the cryocooler 11 is situated in the inner sleeve 31. The cryostat 15 is evacuated as well as the first sleeve 31. Cryogenic liquid such as liquid nitrogen, is supplied to the inlet port 63 and is carried by the piping 57 to the helical passageway in shell 75*a*. The stainless steel piping 57, 59, and 61 and tubing reduce thermal conductivity between the outside of the cryostat and the first stage heat station 33. Forced convection boiling, enhanced by the centrifugal action of the helical passageways initially cools down the first stage heat station and shield 25, connected to the cryocooler interface first stage. The boiling liquid generates cryogenic vapor which enters the second stage heat exchanger 53 gradually cooling the second stage heat exchanger. The stainless steel bellows 31*b* reduces thermal conduction between the first and second stages. During the initial cooling of the second stage heat exchanger with cryogenic vapors, the radiative thermal exchange between the magnet winding form and windings and the shield 25 also causes some gradual and uniform precooling of the magnet windings 21. Once the shield is sufficiently cold, forced convection boiling occurs in the second stage heat exchanger, causing a more rapid cooling of the magnet windings. Towards the end of the cool down, the flow rate of cryogen should be gradually reduced in order to avoid wasting the cryogen liquid. The adjustment in flow rate required can be determined by observing the cryogen emerges from the outlet port and reducing the flow rate if liquid is being discharged with the vapor.

Because of the multistage capability of the precooler, due to the separate heat exchangers, the magnet shields can be cooled first, followed by the magnet itself. The initial gradual cooling of the magnet reduces the temperature gradient within the magnet windings resulting in lower thermal stresses.

In some cases, it may be advantageous to use different cryogenic liquids during precooling. Liquid nitrogen can be used for the initial cooling, down to 77° K., and then liquid helium can be used for further cooling. It may be desirable to change the direction of the coolant flow when liquid helium is introduced in order to cool the second stage heat station and therefore cool the magnet itself to a lower temperature than that of the shield. Once the cooling is complete, all cryogens, liquid and vapor phase must be removed from the heat exchanger and piping. If nitrogen remains in the piping it will freeze during magnet operation, creating a low thermal conduction path from the exterior to the interior of the cryostat. Helium vapor is a good thermal conductor and must be removed from the piping by evacuation.

The foregoing has described a cryogenic precooler which does not require removal of the cryocooler from the cold head interface receptacle avoiding the possibility of frost buildings in the interface. The precooler cools the magnet windings and shield at a controlled rate reducing temperature gradients and therefore thermal stresses.

While the invention has been particularly shown and described with reference to one embodiment thereof, it will be understood by those skilled in the art that various changes in form and detail may be made without departing from the spirit and scope of the invention.

What is claimed is:

1. A superconductive magnet comprising:

a two stage cryocooler having a first and second heat station;

a superconductive magnet winding;

a thermal radiation shield spaced away from and surrounding said winding;

a cryostat defining an aperture spaced away from and surrounding said thermal radiation shield;

a cryocooler cold head interface receptacle situated in said cryostat aperture said interface receptacle providing a first and second heat station for connecting in a heat flow relationship to the cryocooler first and second heat station, respectively, said first and second interface receptacle heat stations thermally insulated from one another; and a precooler having first and second stage heat exchangers connected in a heat flow relationship with said interface receptacle first and second heat stations, respectively, said interface receptacle having inlet and outlet ports for supplying and removing cryogens, and piping means fabricated from heat insulating material for connecting said first and second heat exchangers in a series flow relationship between said inlet and outlet ports.

2. The superconductive magnet of claim 1, wherein said second heat exchanger is situated between said magnet winding and said interface receptacle second stage heat station in a heat flow relationship.

* * * * *